US006305045B1

(12) United States Patent
Walsh et al.

(10) Patent No.: US 6,305,045 B1
(45) Date of Patent: Oct. 23, 2001

(54) PAINT SUPPLY AND FINISHING SYSTEM

(75) Inventors: Michael J. Walsh, Elm Grove; Ann M. Busch, West Bend, both of WI (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/349,535

(22) Filed: Jul. 8, 1999

(51) Int. Cl.[7] ..... B05C 17/02; B05C 21/00

(52) U.S. Cl. ..... 15/230.11; 15/257.06; 101/375; 492/13; 492/19; 206/518; 206/806; 220/570; D4/123

(58) Field of Search ..... 15/210.5, 230.11, 15/257.05, 257.06; 101/375; 118/258, 264, DIG. 14, DIG. 15; 206/518, 806; 220/570; D4/122, 123; D32/53.1; 492/13, 19

(56) References Cited

U.S. PATENT DOCUMENTS

| | | | | |
|---|---|---|---|---|
| 152,212 | * | 6/1874 | Carr | 101/375 |
| D. 230,086 | | 1/1974 | Meisner | D32/53.1 |
| D. 332,512 | | 1/1993 | Bernard | D32/53.1 |
| 1,436,155 | | 11/1922 | Domy | 15/230.11 |
| 1,741,698 | | 12/1929 | Hampson | 427/278 |

(List continued on next page.)

FOREIGN PATENT DOCUMENTS

| | | | |
|---|---|---|---|
| 1035022 | | 7/1958 | (DE) . |
| 1928269 | | 12/1970 | (DE) . |
| 2706001 | * | 8/1978 | (DE) ..... 220/570 |
| 1565411 | | 5/1969 | (FR) . |
| 1378902 | | 12/1974 | (GB) . |
| 9002017 | | 9/1989 | (NL) . |

OTHER PUBLICATIONS

Hawley's Condensed Chemical Dictionary, 13$^{th}$ edition, p. 6.

* cited by examiner

*Primary Examiner*—Mark Spisich
(74) *Attorney, Agent, or Firm*—Foley & Lardner

(57) ABSTRACT

The present invention provides a paint supply and finishing system including a paint roller and a tray. The paint roller includes a handle, a shaft extending from the handle along an access, a paint applying medium having a circumferential surface with a plurality of portion extending and rotatably disposed about the axis and an axial face coupled to the paint applying medium. The paint applying medium applies paint to a surface as a medium is rolled against the surface. The axial face includes at least one location memory indicia. Each indicia corresponds to a particular location on the circumferential surface of the medium. As a result, at least on indicia indicates which of the plurality of portions were last in contact with the surface. The tray includes a pan having a well at a first end and a ramp extending from the well to a second end, first and second spaced legs and a bar. The first and second spaced legs are coupled to the second end of the pan and are configured to support the second end of the pan on a horizontal surface. The bar extends between the first and second legs and includes a detent configured to receive a peg. As a result, the tray may be hung from the peg, providing better visual merchandising of tray sets (trays with lids, holding multiple components) and eliminating significant costs associated with unique wire or plastic tray rack fixtures.

25 Claims, 3 Drawing Sheets

U.S. PATENT DOCUMENTS

| | | | | |
|---|---|---|---|---|
| 2,321,511 | | 6/1943 | Piercy | 15/27 |
| 2,625,702 | | 1/1953 | Grubbs | 15/235 |
| 2,637,272 | | 5/1953 | Hesson | 101/331 |
| 2,680,873 | | 6/1954 | Ernst | 15/160 |
| 2,693,893 | | 11/1954 | Rice et al. | 492/13 |
| 2,708,763 | | 5/1955 | Jacoby | 401/194 |
| 2,731,996 | | 1/1956 | Hayes | 220/555 |
| 2,735,128 | | 2/1956 | Adams | 15/230.11 |
| 2,778,050 | | 1/1957 | Meinhardt | 15/257.06 X |
| 2,799,884 | | 7/1957 | Bedford | 15/230.11 |
| 2,806,803 | | 9/1957 | Thackara et al. | 427/464 |
| 2,838,781 | | 6/1958 | Molle | 15/257.06 |
| 2,840,487 | | 6/1958 | Messina | 427/260 |
| 2,881,461 | | 4/1959 | Parker | 15/230.11 |
| 2,909,797 | | 10/1959 | White | 15/257.06 |
| 2,936,814 | | 5/1960 | Yakubik | 264/271.1 |
| 2,982,981 | | 5/1961 | Waara | 15/230.11 X |
| 3,008,167 | | 11/1961 | Pharris et al. | 15/230.11 |
| 3,126,306 | | 3/1964 | Sherman | 156/187 |
| 3,157,902 | | 11/1964 | Hardwick | 15/257.06 |
| 3,273,700 | | 9/1966 | Moreau et al. | 220/528 X |
| 3,366,719 | | 1/1968 | Lueders | 264/45.8 |
| 3,411,931 | | 11/1968 | Burns et al. | 427/262 |
| 3,457,130 | | 7/1969 | Morrison | 156/190 |
| 3,474,482 | | 10/1969 | Burns et al. | 15/230.11 |
| 3,501,044 | | 3/1970 | Stone | 220/23.4 |
| 3,506,749 | | 4/1970 | Weissman | 264/102 |
| 3,554,659 | | 1/1971 | Stokes | 401/197 |
| 3,562,837 | | 2/1971 | Baginski et al. | 15/230.11 |
| 3,591,299 | * | 7/1971 | Pharris | 15/257.06 X |
| 3,607,492 | | 9/1971 | Keith et al. | 156/79 |
| 3,609,049 | | 9/1971 | Smyth | 401/118 |
| 3,620,869 | | 11/1971 | Stump et al. | 156/190 |
| 3,649,986 | | 3/1972 | Dahlund | 15/230.11 |
| 3,700,520 | | 10/1972 | Hielema | 156/162 |
| 3,745,624 | | 7/1973 | Newman | 492/19 |
| 3,769,058 | | 10/1973 | Bayer et al. | 427/274 |
| 3,793,050 | | 2/1974 | Mumpower, Jr. | 427/462 |
| 3,853,577 | | 12/1974 | Nishida et al. | 427/270 |
| 3,936,541 | | 2/1976 | Plowman et al. | 427/262 |
| 3,950,833 | | 4/1976 | Adams | 492/53 |
| 3,955,260 | | 5/1976 | Sherden | 492/36 |
| 3,958,311 | | 5/1976 | Kusters et al. | 29/895.212 |
| 3,970,396 | | 7/1976 | Brady | 401/208 |
| 4,010,054 | | 3/1977 | Bradt | 156/173 |
| 4,025,205 | * | 5/1977 | Hawk | 15/230.11 X |
| 4,029,011 | | 6/1977 | Kurner | 401/218 |
| 4,078,957 | | 3/1978 | Bradt | 156/173 |
| 4,105,816 | | 8/1978 | Hori | 428/159 |
| 4,164,299 | | 8/1979 | Fuhr | 220/555 |
| 4,164,803 | | 8/1979 | Zurawin et al. | 15/257.05 |
| 4,191,792 | | 3/1980 | Janssen | 15/230.11 X |
| 4,192,697 | | 3/1980 | Parker et al. | 156/188 |
| 4,233,705 | | 11/1980 | Lepage et al. | 15/257.06 |
| 4,257,140 | | 3/1981 | Downing | 15/230.11 |
| 4,293,599 | | 10/1981 | Hori et al. | 427/274 |
| 4,434,521 | | 3/1984 | Martin et al. | 15/230.11 |
| 4,467,509 | | 8/1984 | Dezen | 15/230.11 X |
| 4,692,975 | | 9/1987 | Garcia | 492/29 |
| 4,705,168 | | 11/1987 | Ward | 206/373 |
| 4,800,845 | | 1/1989 | Budd | 220/492.02 X |
| 4,815,604 | * | 3/1989 | O'Neil et al. | 15/257.06 X |
| 4,897,893 | | 2/1990 | Barker | 15/230.11 |
| 4,937,909 | | 7/1990 | Georgiou | 15/230.11 |
| 5,000,671 | | 3/1991 | Nolte | 425/231 |
| 5,048,182 | | 9/1991 | Robbins, III | 29/895.21 |
| 5,117,529 | | 6/1992 | Ohta | 15/230.11 |
| 5,137,595 | | 8/1992 | Garcia | 156/425 |
| 5,167,055 | | 12/1992 | Stoddart et al. | 15/230.11 X |
| 5,178,274 | | 1/1993 | Long | 15/257.06 X |
| 5,206,979 | | 5/1993 | Campbell | 15/230.11 X |
| 5,386,611 | | 2/1995 | Kim | 15/230.11 |
| 5,400,916 | | 3/1995 | Weber | 15/257.06 X |
| 5,406,705 | | 4/1995 | Kildune | 29/895.32 |
| 5,437,593 | | 8/1995 | Gustavsen | 492/13 |
| 5,439,108 | | 8/1995 | Lackie | 206/373 |
| 5,471,703 | | 12/1995 | Niven | 15/230.11 |
| 5,511,279 | | 4/1996 | Ippolito | 15/257.06 |
| 5,533,228 | | 7/1996 | Jarecki et al. | 15/257.06 |
| 5,572,790 | | 11/1996 | Sekar | 29/895.211 |
| 5,577,291 | | 11/1996 | Myers et al. | 15/230.11 |
| 5,594,971 | * | 1/1997 | Nelson | 15/230.11 |
| 5,615,444 | | 4/1997 | Reye | 15/230.11 |
| 5,626,672 | | 5/1997 | Rossetti | 15/230.11 X |
| 5,693,141 | | 12/1997 | Tramont | 15/230.11 X |
| 5,694,688 | | 12/1997 | Musch et al. | 29/895.211 |
| 5,713,095 | | 2/1998 | Wakat | 15/230.11 |

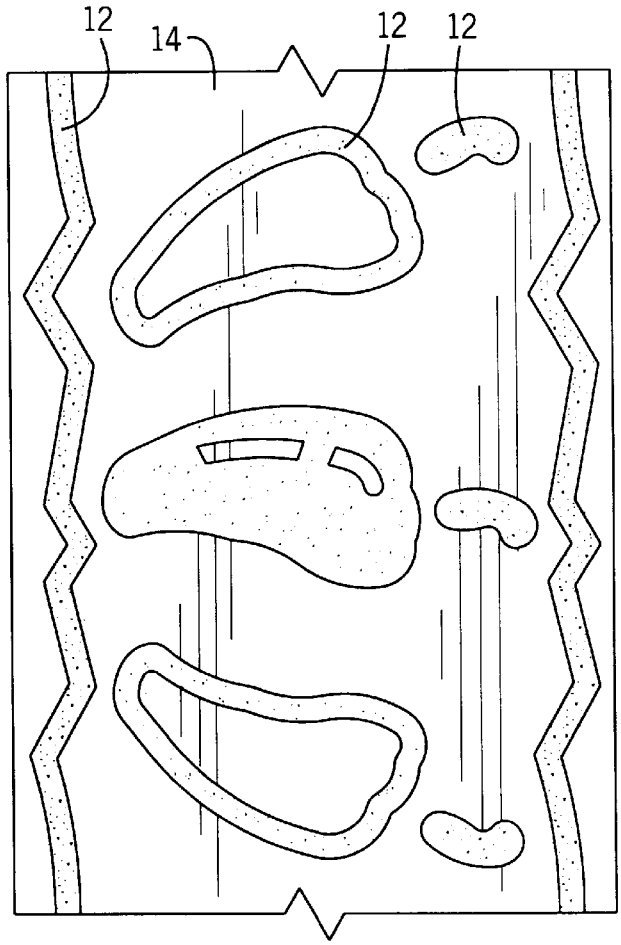
FIG. 1A
FIG. 7
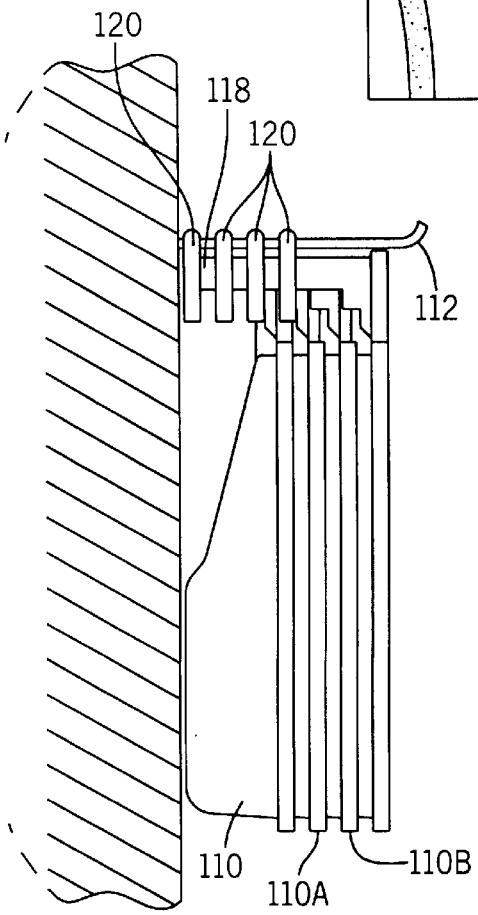
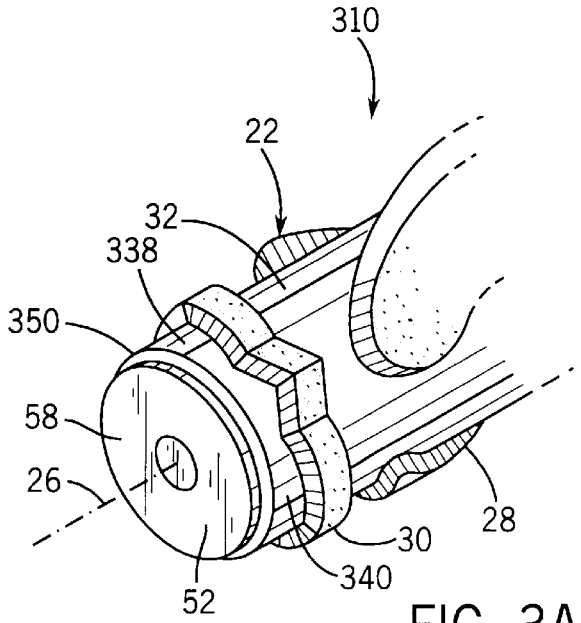
FIG. 3A

PAINT SUPPLY AND FINISHING SYSTEM

FIELD OF THE INVENTION

The present invention relates to paint supply and finishing systems. In particular, the present invention relates to a system including a paint tray configured to be easily hung and nested during display and a paint roller capable of creating continuous unbroken patterns of coatings upon a surface.

BACKGROUND OF THE INVENTION

Many of today's paint supply and finishing systems include utensils for creating a pattern along a wall or other surface. Such utensils include stampers or paint rollers having patterns of elevated and depressed portions.

Paint rollers include patterns of elevated and depressed portions in the circumferential surface of the roller cover. When rolled across the surface being coated, only the elevated portions apply paint to the surface to thereby create a pattern on the surface. Unfortunately, reloading the roller with paint or other fluid coatings requires that the user withdraw the roller from the surface and insert the roller into the tray. Because the roller freely rotates, positioning the roller against the surface in the same position as when the roller was withdrawn from the surface is difficult, if not impossible. As a result, each time the roller is withdrawn from the surface being coated to be reloaded with paint or other coating fluid, the pattern formed on the surface is broken and discontinuous.

Another problem associated with current paint supply finishing systems is the storage and display of the paint tray. Typical paint trays include a well and a ramp extending from the well. The trays further include a base or legs extending from ends of the tray to support the ramp end of the tray on a floor or other horizontal surface during use of the tray. Unfortunately, such configurations are not well adapted for being displayed at a point of sale. With current configurations, the trays typically must be rested upon a horizontal shelf which requires valuable shelf space. Alternatively, to display such trays in a vertical fashion, special wire brackets or racks must be provided.

Thus, there is a continuing need for a paint supply and finishing system which provides a roller capable of forming a continuous unbroken pattern of coating on a surface and a paint tray capable of being vertically displayed without specialized brackets or support structures.

SUMMARY OF THE INVENTION

The present invention provides a paint roller including a handle, a shaft extending from the handle and along an axis, a paint applying medium having a circumferential surface with a plurality of portions extending and rotatably disposed about the axis and an axial face coupled to the paint applying medium. The paint applying medium applies paint to a surface as the medium is rolled against the surface. The axial face includes at least one location memory indicia. Each indicia corresponds to a particular location on the circumferential surface of the medium. As a result, the at least one indicia indicates which of the plurality of portions were last in contact with the surface.

The present invention provides a paint roller for use with a roller cover having a tubular core and a paint applying medium secured thereto. The roller includes a handle, a shaft extending from the handle and along an axis, a cage coupled to the shaft and rotatably supported about the axis and including an axial face, and at least one location memory indicia disposed on the axial face. Each indicia corresponds to a particular location on the axial face.

The present invention provides a paint roller for applying a coating pattern on a surface. The roller includes a handle, a shaft extending from the handle; a substrate rotatably supported about the shaft, a paint applying medium and at least one location memory indicia. The paint applying medium has a pattern of raised and depressed portions. The at least one location memory indicia is carried by the substrate and indicates which of the raised and depressed portions were last in contact with the surface.

The present invention provides a paint supply and finishing system. The paint supply and finishing system includes a paint roller and a paint tray. The paint roller includes a handle, a shaft extending from the handle along an axis, a paint applying medium have a circumferential surface with a plurality of portions extending and rotatably disposed about the axis and an axial face associated with the paint applying medium. The paint applying medium applies paint to a surface as the medium is rolled against the surface. The axial face includes at least one location memory indicia. Each indicia corresponds to a particular location on the circumferential surface of the medium. As a result, the at least one indicia indicates which of the plurality of portions were last in contact with the surface. The tray includes a pan having a well at a first end and a ramp extending from the well to a second end, first and second spaced legs and a bar. The first and second spaced legs are coupled to the second end of the pan and are configured to support the second end of the pan on a horizontal surface. The bar extends between the first and second legs and includes at least one detent configured to receive a peg or other display hardware. As a result, the tray may be hung from the peg.

BRIEF DESCRIPTION OF THE DRAWINGS

FIG. 1A is a side elevational view of the patterned coating formed by the roller of FIG. 1.

FIG. 3A is a fragmentary perspective view of an alternative embodiment of the roller of FIG. 3.

FIG. 7 is a side elevational view of a plurality of nested trays hung from the peg.

DETAILED DESCRIPTION OF THE PREFERRED EMBODIMENTS

Figure 1:
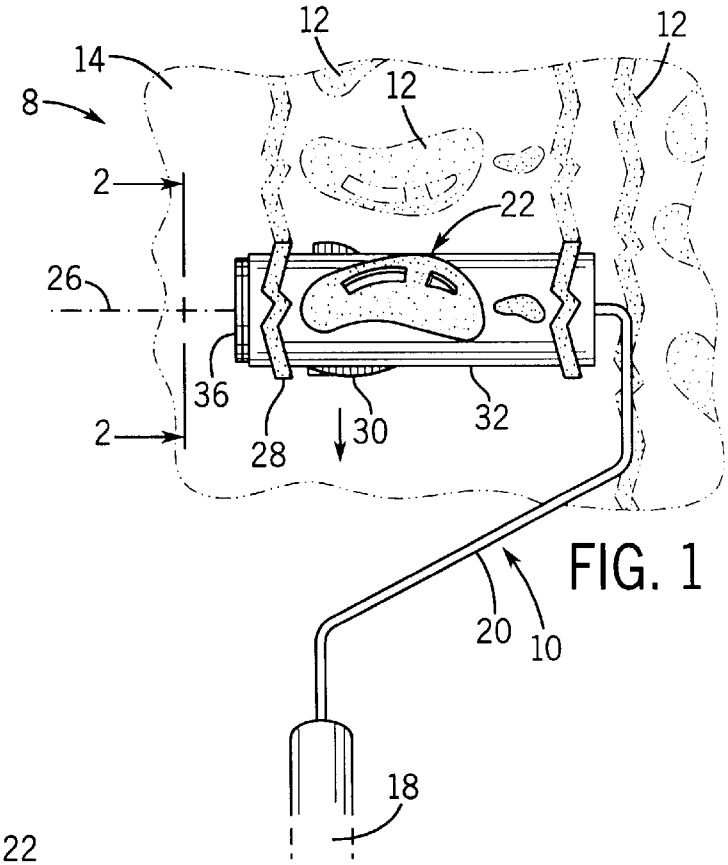
FIG. 1 is a fragmentary top elevational view of a roller of the present invention applying a patterned coating to a surface.
Figure 2:
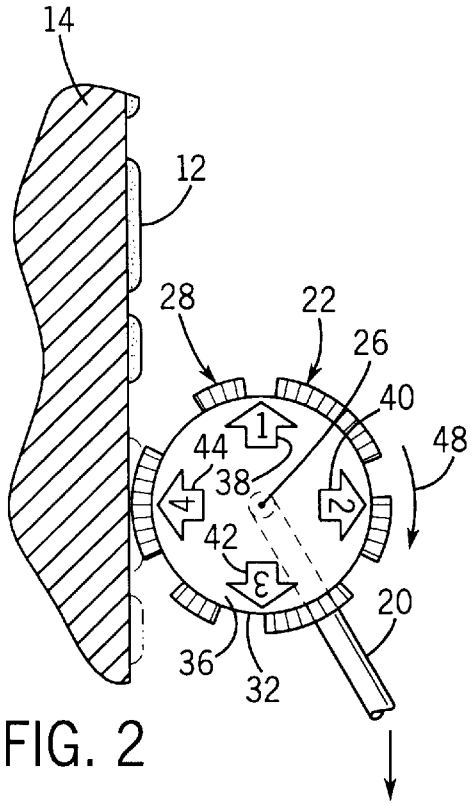
FIG. 2 is an end elevational view of the roller and surface of FIG. 1 taken along lines 2—2.
Figure 3:
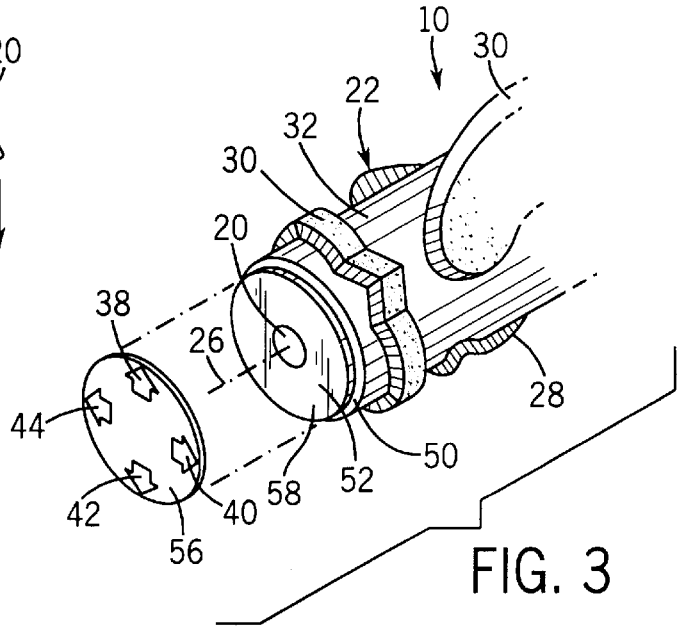
FIG. 3 is a fragmentary exploded perspective view of the roller of FIGS. 1 and 2.

FIGS. 1–7 illustrate paint supply and finishing system 8 including paint roller 10 and tray 110. FIGS. 1–3 illustrate paint roller 10. In particular, FIG. 1 illustrates paint roller 10 applying a coating pattern 12 to a wall or other surface 14. FIG. 2 is an end elevational view of roller 10 and surface 14 taken along lines 2—2 of FIG. 1. FIG. 3 is an fragmentary exploded perspective view of roller 10. As best shown by FIG. 1, roller 10 includes handle 18, shaft 20 and paint applying medium 22. Handle 18 is fixed to shaft 20 and provides a surface about which roller 10 may be grasped by the user. As will be appreciated, handle 18 may be formed at the end of an extension pole. Shaft 20 extends from handle 18 and rotatably supports paint applying medium 22 about an axis 26. Paint applying medium 22 absorbs and releases fluid coatings, such as paint, onto surface 14 to form pattern 12 (shown in FIG. 1A) as paint applying medium 22 is rolled across surface 14. Paint applying medium 22 generally includes a circumferential surface 28 having a plurality of raised portions 30 and a plurality of recessed portions 32. Raised portions 30 are formed from a paint absorbent material such as fabric nap. As will be appreciated, paint applying medium 22 may alternatively be formed from a variety of other materials which include patterned, raised and recessed portions or other surface variations. These materials include, but are not limited to, foam materials, sponge material, nap, natural and synthetic fabrics, looped and rugged material.

As shown by FIG. 2, roller 10 additionally includes an axial face 36. Face 36 includes location memory indicia 38, 40, 42 and 44. Each location memory indicia 38, 40, 42 and 44 corresponds to a particular location on circumferential surface 28 of medium 22. Indicia 38, 40, 42 and 44 indicate which location on the surface of roller 10 was last in contact with surface 14.

In the exemplary embodiment, location memory indicia 38, 40, 42 and 44 are equidistantly spaced and located about axis 26 and preferably comprise alphanumeric symbols. To further facilitate precise identification of the particular portion 30 last in contact with surface 14, indicia 38, 40, 42 and 44 each include an arrow pointing to a precise location along circumferential surface 28. To enable the user to quickly and easily distinguish between indicia 38, 40, 42 and 44, each of indicia 38, 40, 42 and 44 is numbered. As a result, when paint applying medium 22 has been sufficiently exhausted of fluid coating such that paint applying medium 22 needs to be reloaded with fluid coating, the user simply rolls medium 22 in the direction indicated by arrow 48 until one of indicia 38, 40, 42 and 44 points to surface 14. Alternatively, if the previously applied pattern 12 is not being sufficiently visible or thick, indicia 38, 40, 42 and 44 enable the user to apply additional coatings of paint to thicken or darken the previously applied pattern 12 by simply rolling medium 22 in an opposite direction. In the example illustrated in FIG. 2, indicia 44, having numerical identifier 4, is positioned so as to point to surface 14. Roller 10 may then be withdrawn from surface 14 and loaded with paint or other fluid coatings. To once again initiate the application of fluid coating to surface 14, the user merely positions medium 22 against surface 14 with indicia 44 pointing to surface 14 where pattern 12 left off. At this point and time, the user can continue with rolling medium 22 across surface 14 in the direction indicated by 48. Consequently, roller 10 enables the user to create a continuous unbroken pattern 12, quickly and efficiently, despite the fact that roller 10 must be repeatedly withdrawn from surface 14 to reload medium 22 with fluid coatings or paint.

FIG. 3 illustrates roller 10 in greater detail. As shown by FIG. 3, paint applying medium 22 is preferably formed as part of a conventionally known tubular roller cover 50 which removably receives cage 52. Roller 10 preferably includes a cage 52 rotatably supported about shaft 20. Cage 52 is described in greater detail in co-pending U.S. patent application Ser. No. 08/907,847 entitled "Roller Having Slip-On Cage For Paint Roller Cover", filed on Feb. 6, 1995, U.S. Pat. No. 5,979,009, the full disclosure which is hereby incorporated by reference. Cage 52 supports roller cover 50 about axis 26. As will be appreciated, paint applying medium 22 may alternatively be formed as part of a roller cover adapted to receive a variety of different paint roller cages. Furthermore, paint applying medium 22 may alternatively be permanently formed as part of a member permanently fixed to a roller, such as a disposable roller.

As further shown by FIG. 3, indicia 38, 40, 42 and 44 are preferably imprinted, embossed, or otherwise displayed upon a panel 56 which is affixed to an axial face 58 of cage 52. In exemplary embodiment, panel 56 is adhesively bonded to face 58 of cage 52. Panel 56 may be alternatively secured to face 52 or to cover 50 by various other structures and methods, such as mechanical fasteners, welding and the like. Moreover, in lieu of being provided on panel 56, which is affixed to cage 52, indicia 38, 40, 42 and 44 may alternatively molded, etched, printed, or otherwise displayed directly upon face 58 of cage 52 or other structures that rotate about axis 26 with paint applying medium 22.

Figure 4:
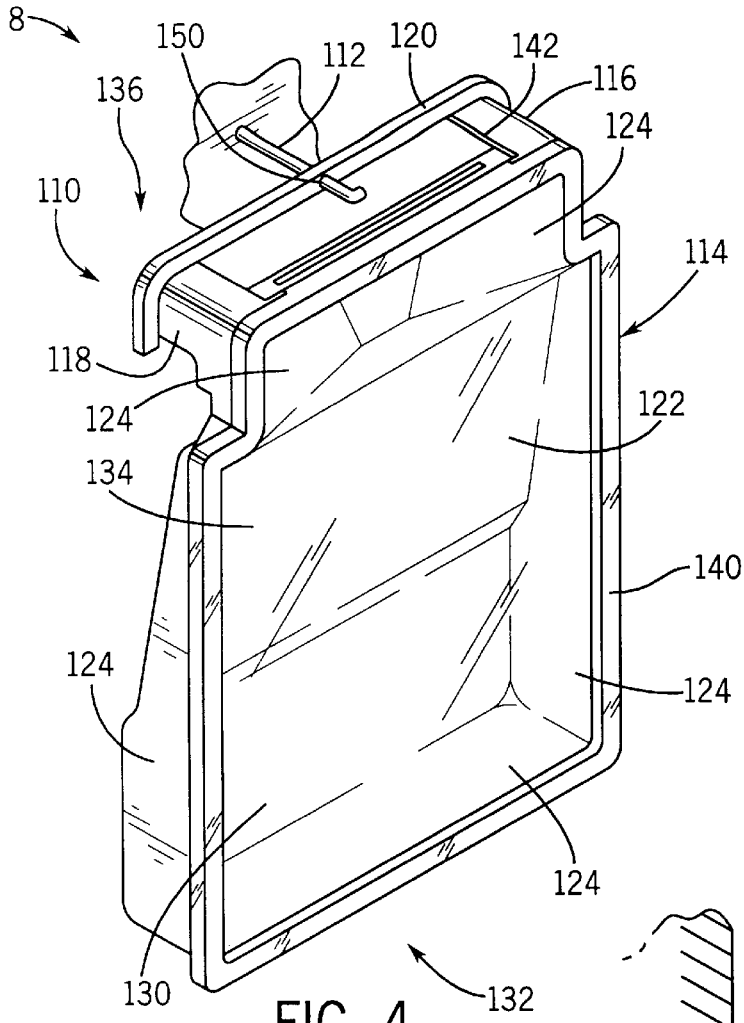
FIG. 4 is a perspective view of a tray of the present invention hung from a peg.

FIG. 4 illustrates fluid or paint tray 110 hung upon peg 112. Tray 110 generally includes pan 114, legs 116, 118 and foot 120. Pan 114 generally includes a bottom 122 and a plurality of upstanding walls 124 extending from bottom 122 to thereby form well 130 at end 132 and ramp 134 extending from well 130 towards end 136. Ramp 134 angularly extends upwardly from well 130 towards an upper perimeter 140 of pan 114. In use, well 130 contains fluid coating or paint to be rolled and loaded on to roller 10 (shown in FIGS. 1–3).

Legs 116 and 118 are spaced apart from one another and are separated by a gap 142 therebetween. Legs 116 and 118 extend from pan 114 at end 136 so as to support end 136 and ramp 134 above well 130.

Figure 5:
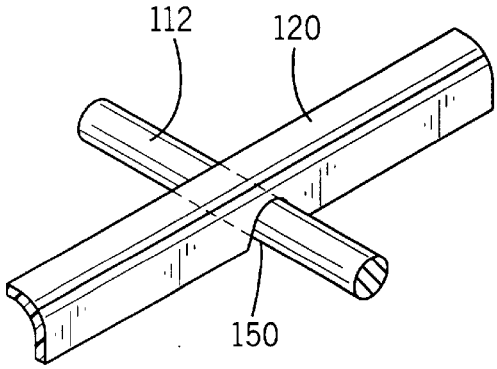
FIG. 5 is a enlarged fragmentary perspective view of a portion of the tray of FIG. 4 hung from the peg.

Foot 120 comprises an elongate band or bar extending between legs 116 and 118. In the exemplary embodiment, foot 120 extends adjacent to ends of legs 116 and 118 so as to simultaneously rest upon a horizontal surface with the ends of legs 116 and 118. As shown by FIG. 5, foot 120 includes a detent 150 sized to receive peg 112. Detent 150 preferably comprises a notch extending into a side of foot 120 in a direction away from end 132 of pan 114. Although less desirable, foot 120 may alternatively include a detent comprising a hole through which peg 112 may be inserted.

As will be appreciated, foot 120 and detent 150 may have a variety of configurations depending upon the particular configuration of the particular shelf-hanging apparatus employed. For example, although detent 150 is illustrated for receiving peg 112 comprising a single-pointed peg or rod, detent 150 may alternatively be configured for receiving a peg which has a rounded bulbous end or which is generally U-shaped at its end. Moreover, foot 120 may alternatively include two or more detents 150 between legs 116 and 118 where the shelving system utilizes two or more variously configured pegs.

Figure 6:
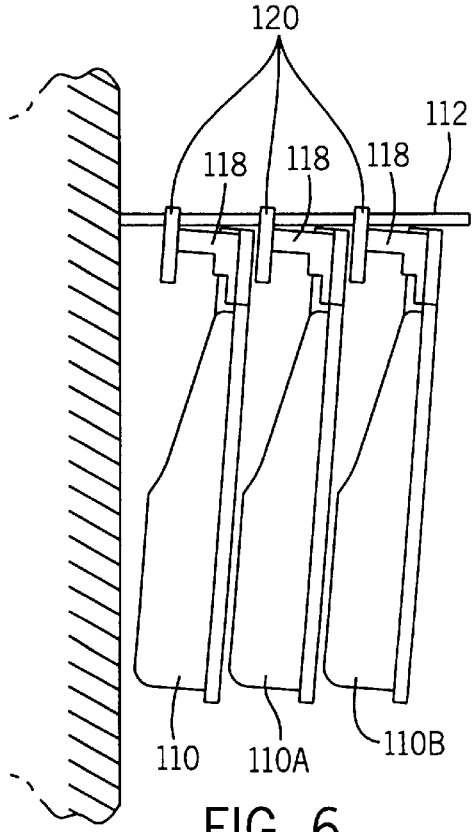
FIG. 6 is a side elevational view of a plurality of trays hung from the peg.

As shown by FIG. 4, foot 120 and detent 150 enable tray 114 to be hung upon standard store hooks or pegs, such as peg 112, in a generally vertical orientation without complicated, specially designed expensive wire frame support structures or tray rack. As shown by FIG. 6, tray 110 has a center of gravity in substantial vertical alignment with detent 150 when tray 110 is hung from peg 112. As a result, tray 110 hangs in a substantially vertical orientation when hung upon peg 112 to produce a more visually appealing display. In addition, because tray 110 hangs in a substantially vertical orientation, accessories enclosed within the interior of tray 110 by a transparent lid or cover, are also more visually apparent. In addition to providing a more visually appealing display, tray 110 may also be hung from peg 112 while being nested at least partially within an adjacent tray 110 as shown in FIG. 7. In particular, tray 110A may be nested at least partially within tray 110 while tray 110B may be partially nested within tray 110A, all while being hung upon a single peg 112. This ability enables an inventory of trays 110 to be displayed on a single peg 112 without requiring a large amount of display space.

FIG. 3A is a fragmentary perspective view of roller 310, an alternative embodiment of roller 10. Roller 310 is similar to roller 10 except that roller 310 includes location memory indicia 338 and 340 in lieu of memory indicia 38 and 40. In contrast to indicia 38 and 40, indicia 338 and 340 are permanently formed as part of roller cover 350. In the exemplary embodiment, indicia 338, 340 are formed in the circumferential end surface portions of cover 350. Alternatively, indicia 338, 340 may be formed in the axial end portions of cover 350. Indicia 338, 340 preferably comprise markings made upon cover 350. Alternatively, indicia may comprise notches, protruberances or forms of identifying marks. Furthermore, in lieu of being formed upon a removable cover 350, indicia 338, 340 may be formed upon or in an alternative form of a substrate supporting medium 22, such as a substrate which is permanently mounted to handle 18 (shown in FIG. 1). Although only two indicia are shown in FIG. 3A, roller 310 preferably includes a plurality of equidistantly spaced indicia about axis 26 of roller 310. Although less desirable, indicia may also be formed in the pattern upon roller 310 itself.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A paint roller comprising:

a handle;

a shaft extending from the handle and along an axis;

a paint absorbing and applying medium having a circumferential surface with a plurality of raised and depressed portions extending and rotatably disposed about the axis, whereby the paint applying medium applies paint to a surface as the medium is rolled against the surface; and an axial face coupled to the paint applying medium, the face having continuous uninterrupted outer circumference and including a plurality of visually distinct location memory indicia disposed within the outer circumference, each indicia corresponding to a particular location on the circumferential surface of the medium, whereby the plurality of indicia indicates which of the plurality of portions were last in contact with the surface.

2. The roller of claim 1 wherein each of the plurality of location memory indicia are equidistantly located about the axis.

3. The roller of claim 1 wherein the plurality of location memory indicia comprise distinct alpha-numeric symbols.

4. The roller of claim 3 wherein at least one of the plurality of location memory indicia includes arrow.

5. The roller of claim 1 wherein at least one of the plurality of location memory indicia includes an arrow.

6. The roller of claim 1 including a panel having a first side and a second side, wherein the first side provides the plurality of location memory indicia and wherein the second side is adhesively coupled relative to the paint applying medium.

7. The roller of claim 1 including:

a cage rotatably disposed about the axis of the shaft; and a tubular core configured to receive the cage, wherein the core supports the paint applying medium.

8. The roller of claim 1 wherein at least one raised portion has a perimeter and wherein every portion of the perimeter has a fixed underlying end.

9. The roller of claim 1 wherein at least one raised portion is formed from at least one of the following: fabric nap, foam material, sponge material, looped material or rugged material.

10. A paint roller for use with a roller cover having a tubular core and a paint applying medium secured thereto, the roller comprising:

a handle;

a shaft extending from the handle and along an axis; and a cage coupled to the shaft and rotatably supported about the axis, the cage having an axial face; and a plurality of distinct circumferentially spaced location memory indicia disposed on the axial face, each indicia corresponding to a particular location on the axial face, wherein at least two consecutive indicia are spaced less than 180 degrees apart.

11. The roller of claim 10 wherein each of the plurality of location memory indicia are equidistantly located about the axis.

12. The roller of claim 10 wherein the plurality of location memory indicia comprise alpha-numeric symbols.

13. The roller of claim 12 wherein at least one of the plurality of location memory indicia includes an arrow.

14. The roller of claim 10 wherein at least one of the plurality of location memory indicia includes an arrow.

15. The roller of claim 10 including a panel having a first side and a second side, wherein the first side provides the plurality of distinct location memory indicia and wherein the second side is adhesively coupled to the axial face of the cage.

16. A paint tray comprising:

a pan having a well at a first end and a ramp extending from the well to a second end;

first and second spaced legs coupled to the second end of the pan, wherein the legs are configured to support the second end of the pan on a horizontal surface; and a bar having a length extending between the first and second legs, wherein the bar includes a detent extending through a wall of the bar, spaced between the first and second legs and configured to receive a peg such that the peg generally extends perpendicular to the bar, whereby the tray may be hung from the peg.

17. The tray of claim 16, wherein the first and second legs have first and second ends configured to rest upon the horizontal surface and wherein the bar extends between the first and second ends so as to also rest upon the horizontal surface.

18. The tray of claim 16, wherein the detent comprises a notch extending in a surface of the bar towards the first end.

19. The tray of claim 16, wherein the tray has a center of gravity and wherein the detent is located on the bar such that the tray hangs in a substantially vertical orientation when hung upon the peg.

20. The tray of claim 16, wherein the pan, first and second legs and the bar are configured such that the paint tray at least partially nests within an adjacent similarly configured paint tray when being hung from a single peg.

21. A paint roller for creating a coating pattern on a surface, the roller comprising:

a handle;

a shaft extending from the handle;

a substrate rotatably supported about an axis of the shaft;

a paint absorbing and applying medium supported by the substrate, the medium having raised and depressed portions; and a plurality of visually distinct location memory indicia carried by the substrate, whereby the plurality of visually distinct indicia indicate which of the raised and depressed portions were last in contact with the surface wherein at least two consecutive indicia are spaced less than 180 degrees apart.

22. A paint supply and finishing system comprising:

a paint roller including:

a handle;

a shaft extending from the handle along an axis;

a paint absorbing and applying medium having a circumferential surface with a plurality of raised and depressed portions extending and rotatably disposed about the axis, whereby the paint applying medium applies paint to a surface as the medium is rolled against the surface; and an axial face associated with the paint applying medium, the face including at least one location memory indicia, each indicia corresponding to a particular location on the circumferential surface of the medium, whereby the at least one indicia indicates which of the plurality of portions were last in contact with the surface; and a paint tray for loading paint onto the paint applying medium of the roller, the tray including:

a pan having a well at a first end and a ramp extending from the well to a second end;

first and second spaced legs coupled to the second end of the pan, wherein the legs are configured to support the second end of the pan on a horizontal surface; and a bar extending between the first and second legs, wherein the bar includes detent extending through a wall of the bar, spaced between the first and second legs and configured to receive a peg such that the peg generally extends perpendicular to the bar, whereby the tray may be hung from the peg.

23. A paint roller comprising:

a handle;

a shaft extending from the handle and along an axis;

a paint applying medium having a circumferential surface with a plurality of portions extending and rotatably disposed about the axis, whereby the paint applying medium applies paint to a surface as the medium is rolled against the surface; and an axial face coupled to the paint applying medium, the face including at least one location memory indicia, each indicia corresponding to a particular location on the circumferential surface of the medium, whereby the at least one indicia indicates which of the plurality of portions were last in contact with the surface; and a panel having a first side and a second side, wherein the first side provides the at least one memory indicia and wherein the second side is adhesively coupled relative to the paint applying medium.

24. A paint roller for use with a roller cover having a tubular core and a paint applying medium secured thereto, the roller comprising:

a handle;

a shaft extending from the handle and along an axis; and a cage coupled to the shaft and rotatably supported about the axis, the cage having a n axial face;

at least one location memory indicia disposed on the axial face, each indicia corresponding to a particular location on the axial face; and a panel having a first side and a second side, wherein the first side provides the at least one location memory indicia and wherein the second side is adhesively coupled to the axial face of the cage.

25. A paint tray comprising:

a pan having a well at a first end and a ramp extending from the well to a second end;

first and second spaced legs coupled to the second end of the pan, wherein the legs are configured to support the second end of the pan on a horizontal surface; and a bar extending between the first and second legs, wherein the bar includes a detent configured to receive a peg, whereby the tray may be hung from the peg, wherein the detent comprises a notch extending in a surface of the bar towards the first end.

* * * * *